US006202224B1

(12) United States Patent
Freeman

(10) Patent No.: US 6,202,224 B1
(45) Date of Patent: Mar. 20, 2001

(54) EXPANDABLE AND SPILL-PROOF CONTAINER AND METHOD FOR DISPOSING OF LIQUIDS

(76) Inventor: Ronald A. Freeman, Rte. 4, Box 32 G, Keyser, WV (US) 26726

( * ) Notice: Subject to any disclaimer, the term of this patent is extended or adjusted under 35 U.S.C. 154(b) by 0 days.

(21) Appl. No.: 09/415,337

(22) Filed: Oct. 8, 1999

Related U.S. Application Data

(60) Provisional application No. 60/103,791, filed on Oct. 9, 1998.

(51) Int. Cl.[7] ..... A47K 11/00

(52) U.S. Cl. ..... 4/144.2; 4/144.1; 4/452; 4/484

(58) Field of Search ..... 4/144.1–144.3, 4/452, 484; 128/205.16

(56) References Cited

U.S. PATENT DOCUMENTS

| | | | | |
|---|---|---|---|---|
| 2,654,892 | | 10/1953 | Szabo | 4/110 |
| 3,299,442 | | 1/1967 | White et al. | 4/110 |
| 3,495,278 | * | 2/1970 | Peters | 4/144.2 |
| 4,749,600 | | 6/1988 | Cullen et al. | 428/35 |
| 4,820,291 | | 4/1989 | Terauchi et al. | 604/349 |
| 4,996,727 | | 3/1991 | Wyatt | 4/484 |
| 5,007,116 | | 4/1991 | Yamamoto | 4/144.2 |
| 5,243,712 | | 9/1993 | Cross | 4/144.2 |
| 5,307,819 | | 5/1994 | Trautmann et al. | 128/767 |
| 5,329,644 | | 7/1994 | Scott | 4/144.2 |
| 5,406,650 | * | 4/1995 | Einbinder | 4/144.2 |
| 5,455,972 | * | 10/1995 | Williams | 4/452 |
| 5,531,724 | | 7/1996 | Young et al. | 604/327 |
| 5,605,161 | | 2/1997 | Cross | 128/771 |

FOREIGN PATENT DOCUMENTS

| | | | |
|---|---|---|---|
| 549850 A1 | * | 7/1993 | (EP) . |
| 9-28616 | * | 2/1997 | (JP) . |

* cited by examiner

*Primary Examiner*—David J. Walczak
*Assistant Examiner*—Tuan Nguyen
(74) *Attorney, Agent, or Firm*—Steptoe & Johnson PLLC

(57) ABSTRACT

A portable container for disposing of liquid waste products is disclosed having an expandable container into which an impermeable liner is inserted. The liner is secured to the container to prevent spillage and leaks. Furthermore, a water soluble gel pack is placed in the liner such that when a liquid waste product is deposited into the liner, the water soluble gel pack dissolves and the gel powder contained therein reacts with the liquid waste product thereby transforming it into a gel form, a solidified waste product, for easy disposal. The liner containing the solidified waste product is removed from the expandable container and disposed of by conventional means, enabling in the expandable container to be reused with a new liner and water soluble gel pack.

13 Claims, 4 Drawing Sheets

EXPANDABLE AND SPILL-PROOF CONTAINER AND METHOD FOR DISPOSING OF LIQUIDS

CROSS-REFERENCE TO RELATED APPLICATION

This application claims the benefit of Application No. 60/103,791, filed Oct. 9, 1998.

BACKGROUND OF THE INVENTION

1. Field of Technology

The present invention relates to portable waste containers, and more specifically, to a reusable, expandable and portable container for disposing of liquid waste products.

2. Related Art

Conventional portable urinals typically comprise a solid container of a fixed size and dimension having a top that provides a tight fit to the container. To use such a conventional portable urinal, a person simply uncaps it, uses it, and recaps it, thereby having to dispose of its contents at a later time.

There are several disadvantages with conventional portable urinals. Conventional containers typically are of a fixed size and dimension, thereby being cumbersome to store. Also, by being a fixed size, a finite amount of urine, or other liquid waste products, will fit within the container. Therefore, there is a need for a portable container that can store varying amounts of a liquid waste product, e.g., urine.

Another disadvantage is that when used, the urine remains in the container in a liquid form resulting in a strong possibility that the urine may spill or emit a strong odor from the container. Both of which are unpleasant experiences. Therefore, there is a need for a portable container that solidifies the urine or liquid waste product contained therein, eliminating all odors and the possibility of the liquid waste product from spilling out of the container.

Furthermore, after being used, conventional portable urinals must be either thrown away with the contents or the contents removed and the container cleaned for the next use. Neither of these options is attractive. If every conventional container is thrown away, then it becomes harmful to the environment as well as expensive for the user to maintain a constant supply of containers. If the conventional container requires cleaning after each use, then the user must handle the unpleasant task of cleaning out the container. Therefore, there is a need for a portable container that eliminates the need to dispose of the entire portable container or to clean the container between uses, thereby facilitating the disposal of liquid waste products. There is a further need for a portable container that facilitates repeated use of the portable container that is safe for the environment and convenient for the user.

In U.S. Pat. No. 2,654,892 to Szabo, a relief container is disclosed for use in automobiles. This relief container comprises a bag having a rigid ring assembly inserted through a pocket located along the top rim of the bag and secured in place with a draw-string. The ring assembly holds the top of the bag open. Once a liquid waste product, e.g., urine, is deposited in the bag, the top of the bag is twisted and tied shut. There are several disadvantages of the Szabo relief container. First, the bag itself is unstable to hold as it is being used. A user must hold the ring assembly during use and therefore runs the risk of coming into contact with the liquid waste product as it is being deposited. Second, the ring assembly is a cumbersome feature that requires multiple pieces, all of which may easily be lost or broken, thereby rendering the relief container inoperative. Furthermore, the liquid waste product maintains its liquid form until its disposal which means that the liquid may spill or otherwise leak from a tear in the bag or an accidental opening of the top of the bag.

In U.S. Pat. No. 3,299,422 to White, et al., a drainage bottle having a hanger support is disclosed wherein the drainage bottle may be stored in a collapsed position prior to use. Despite this collapsible feature, the drainage bottle is still a finite size regardless of the amount of liquid deposited therein and can only contain a fixed amount of liquid. Also, upon being used, the drainage bottle must be disposed of in its entirety or cleaned out for a subsequent use—either of which is not a preferred feature.

In U.S. Pat. No. 4,749,600 to Cullen, et al., a liquid absorbing and immobilizing packet is disclosed wherein the packet is degradable in a liquid and the material contained within the packet transforms the liquid into a gel-like substance. The packet is intended for the sole purpose of being used in a container such that any leak of a liquid from an object stored within the container is prevented, thereby protecting the container from damage and becoming weak.

In U.S. Pat. No. 4,996,727 to Wyatt, a disposable waste bag is disclosed for use with a bedpan or other portable commode. However, this waste bag does not incorporate any means for securing the bag closed, thereby preventing any spillage or leaking of the contents. The waste bag simply provides a means to carry the bag and its contents wherein the contents remain in a liquid state. In addition, a user would not be able to use the waste bag without a support framework to hold onto because it would be very cumbersome for a user to hold the bag while attempting to use it.

In U.S. Pat. No. 5,007,116 to Yamamoto, a portable urinal is disclosed being a fixed-size storage bag wherein the top mouth portion is more rigid than the bottom portion. In addition, a pouch is located at the bottom of the storage bag into which is placed a water-absorbing agent for forming a gel when brought in contact with the urine or other liquid waste product. After use, the portable urinal is to be thrown away.

There are many disadvantages associated with the Yamamoto portable urinal. One disadvantage is that a user must hold the urinal near the top mouth because that is the only portion of the urinal that is rigid and provides a secure grip. Because the remainder of the urinal is less rigid, it would be difficult to hold steady while in use. In addition, because this portable urinal is not intended to be reused, a user must purchase multiple urinals for repeated use, thereby requiring excess storage space and expense.

Another disadvantage with the Yamamoto portable urinal is the means by which the water-absorbing agent is brought into contact with the liquid waste product. In the preferred embodiment, the water-absorbing agent is stored in a water permeable, water insoluble pocket located on the interior of the bottom of the storage bag. Therefore, when the liquid waste product is deposited into the storage bag, the liquid waste product permeates the pouch, is absorbed by the water-absorbing agent which becomes swollen as it becomes a gel. This expansion into a gel causes the pocket to burst into fragments, thereby dispensing the remainder of the water-absorbing agent into the liquid waste product. This means for changing the liquid waste product into a gel results in several problems. First, the liquid waste product may never be gelled if the pouch fails to break. Also, enough liquid waste product must be deposited into the storage bag such that the water absorbing agent swells and bursts the pouch. An insufficient amount of a deposit results in the deposit keeping its liquid form.

Despite all of the different apparatuses disclosed in these prior patents, there continues to be a need for an expandable container that is safe, sanitary, and has the ability to transform a liquid waste product into a gel form to facilitate its disposal. There is also a need for a portable container that can adapt to different volumes of liquid wherein the expandable container is easily handled and managed during use. Further, there is a continued need for an expandable container that can be used repeatedly for the storage and disposal of liquid waste products, thereby eliminating the need for cleaning the portable container between uses and eliminating the need for a user to purchase multiple portable containers.

SUMMARY OF THE INVENTION

The present invention solves the problems associated with conventional containers by providing a portable container that combines an expandable container with an impermeable liner inserted therein and a water soluble gel pack. During use, the container is expanded to the desired size, the liner is placed within the expanded container and the water soluble gel pack is placed within the liner. When a liquid waste product is deposited into the liner in the expandable container, the water soluble gel pack dissolves and solidifies the liquid waste product into a gel form, a solidified waste product. The liner and the solidified waste product is removed from the expandable container and disposed of without spilling or leaking. The expandable container is then returned to a retracted position for storage and future use with a new liner and water soluble gel pack.

There are several advantages with the portable container of the present invention. When in a retracted position, the portable container requires less space to store or pack and is easier to conceal. Therefore, the present invention is easier to store than conventional containers and is less obvious to the casual observer. The portable container can also be altered to the needed size, thereby accommodating any needed use for the container, such as disposing of a minimum amount of a liquid waste product or a large amount of a liquid waste product.

The present invention also makes it easier to dispose of the liquid waste product contained therein. Because the liquid waste product is converted to a gel form within seconds, it is less likely to spill or leak from the container as well as being less likely to emit an offensive odor.

The present invention also provides for multiple uses because the preferred embodiment incorporates the use of a liner. After being use, the solidified waste liquid is disposed of along with the liner, thereby allowing the container to be used repeatedly without cleaning. In addition, the liner of the present invention is leak resistant and safe for everyday trash receptacles, resulting in the portable container being safe for the environment.

There are many uses for the portable container of the present invention. For example, the present invention can be used as a portable urinal, as a container for those suffering from motion sickness or a similar ailment, or as a container for other liquid waste products, e.g., blood. Therefore, the present invention can be used by automobile drivers and passengers, boaters, small aircraft occupants, campers, hikers, children on long trips, railway workers, military personnel who have been deployed, or by any person who is situated such that restroom or similar facilities are not readily available.

DESCRIPTION OF THE FIGURES

The present invention is described with reference to the accompanying drawings. In the drawings, like reference numbers indicate identical or functionally similar elements. Additionally, the left-most digit(s) of a reference number identifies the drawings in which the reference number first appears.

DETAILED DESCRIPTION OF THE PREFERRED EMBODIMENTS

A. Structure

Figure 1:
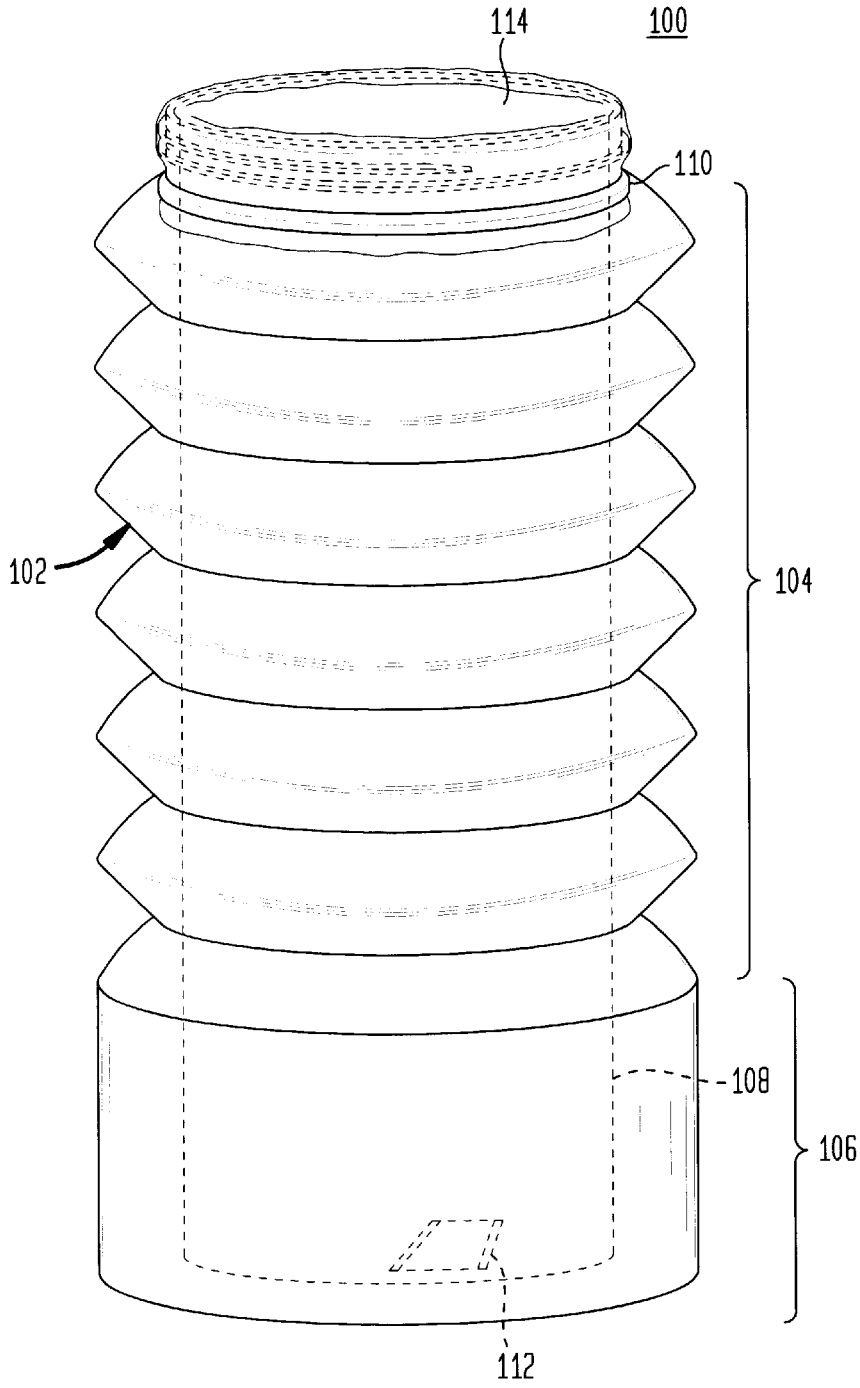
FIG. 1 is a planar view of a portable container of the present invention, in an extended position, having a liner and a gel pack inserted therein.
Figure 2:
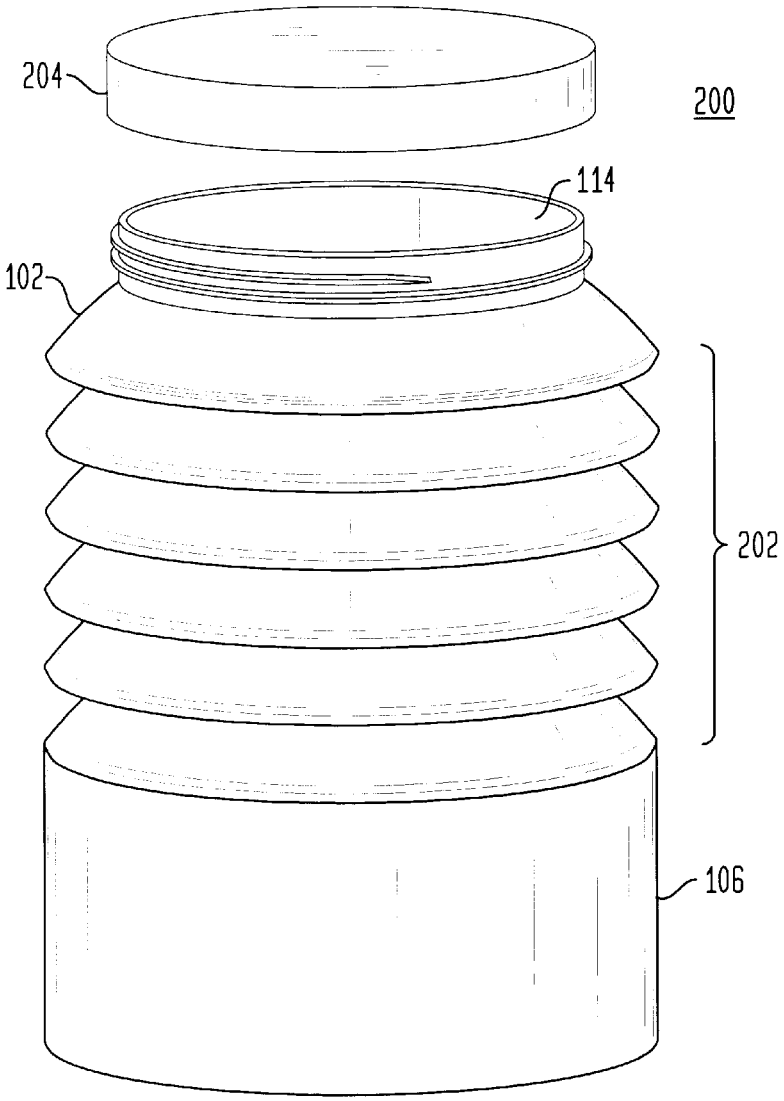
FIG. 2 is a planar view of the portable container of the present invention in a retracted position.
Figure 3:
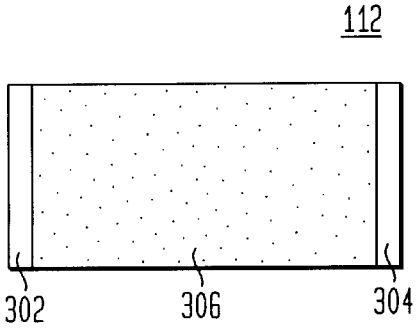
FIG. 3 is a planar view of a preferred embodiment of a gel pack.
Figure 4:
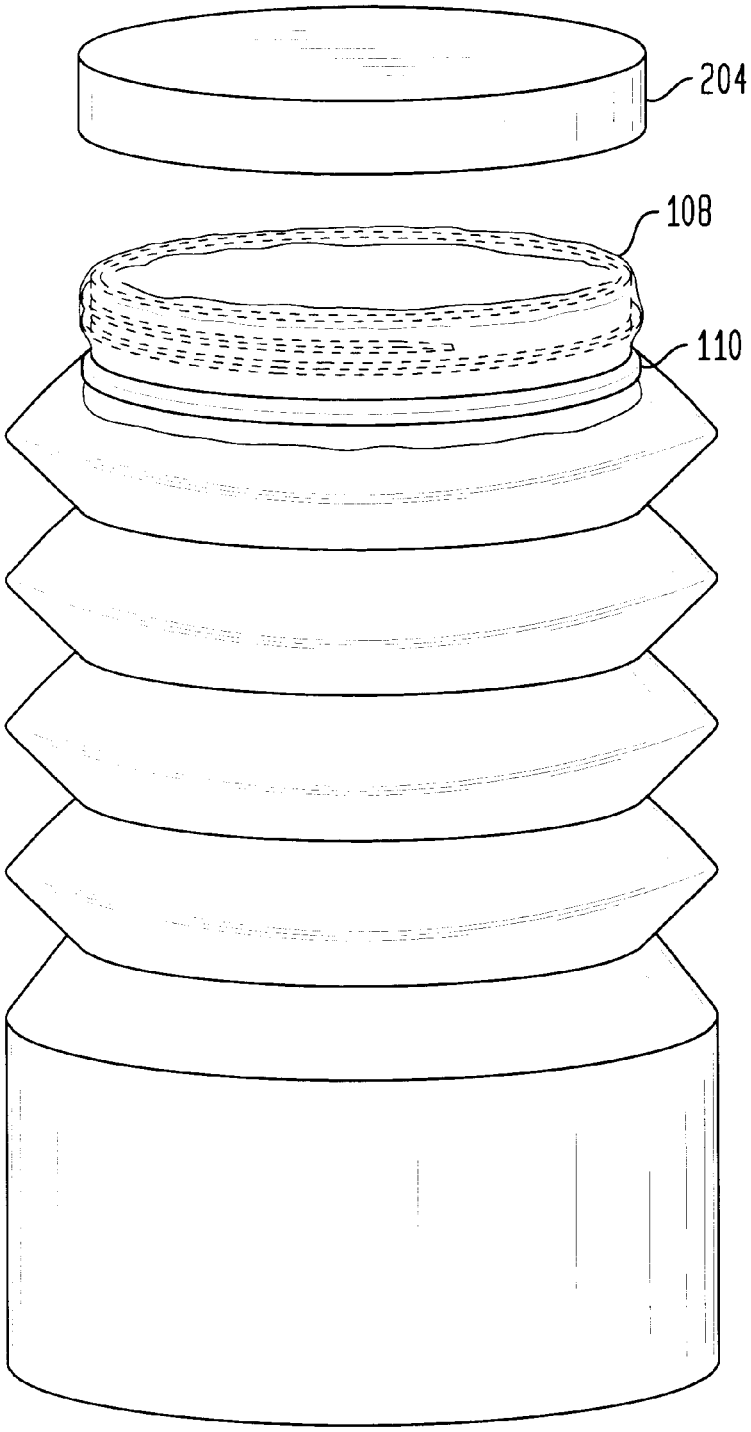
FIG. 4 is a perspective view of the portable container.

FIGS. 1–2 are planar views of a portable container 100 of the present invention, wherein FIG. 1 shows the portable container 100 in an extended position 104 and FIG. 2 shows the portable container 100 in a retracted position 202. A perspective view of the portable container 100 is shown in FIG. 4 and the preferred embodiment of a gel pack 112 of the present invention is shown in FIG. 3.

Figure 5:
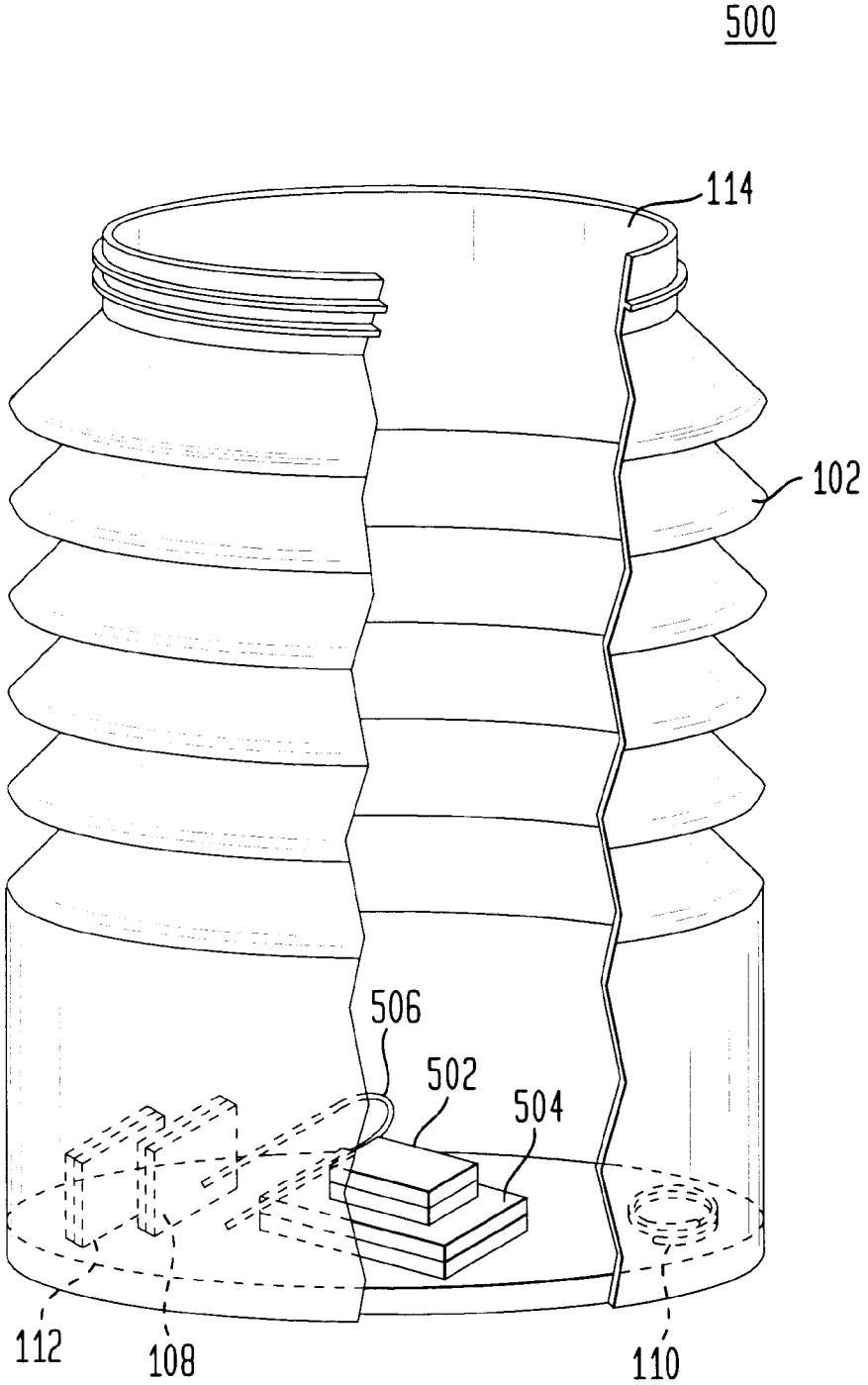
FIG. 5 is a cut-away view of the portable container of FIG. 2

FIG. 5 is a cut-away view of the portable container 100 packaged for transport and use.

The preferred embodiment of the portable container 100 comprises a commercially available expandable container 102 having an opening, a lid 204 for closing the opening, and a means for expanding the container 102. The expandable container 102 is a flexible plastic container in which a portion of the walls 104 comprise an expandable, accordion wall structure and the remainder of the walls 106 of the container 102 is rigid. The expandable container 102 can be interchanged between a retracted position 202 and an extended position 104 by simply pushing and pulling on the top of the expandable container 102. In a retracted position 202, the expandable container 102 is compressed into a short height, and in an extended position 104, the expandable container 102 is extended into a long height. In an alternative embodiment, the walls of the expandable container 102 may be entirely expandable, thereby eliminating the remainder of the walls 106 that is rigid. The preferred embodiment of the expandable container 102 of the present invention is described in these terms for convenience purpose only. It would be readily apparent for one of ordinary skill in the relevant art to use any expandable container with the present invention.

Also in the preferred embodiment, a liner 108 is used with the expandable container 102 wherein the liner 108 is impermeable to liquids. The liner 108 is a plastic bag having approximate dimensions similar to the internal dimensions of the expandable container 102 and fits within the expandable container 102. The preferred embodiment also incorporates a means for securing the liner 108 to the opening 114 of the expandable container 102 so that during use, the liner 108 does not slip out of place such as falling within the expandable container 102. In the preferred embodiment, the liner 108 is secured to the opening 114 of the expandable container 102 with a rubber band 110. A rubber band 110 is well know in the art and it would be readily apparent for one of ordinary skill in the relevant art to use a rubber band 110 as a means for securing the liner 108. The use of a rubber band 110 however is for convenience purpose only. It would be readily apparent for one of ordinary skill in the relevant art to use a comparable means for securing the liner 108, e.g., a tie, clips, fasteners, snaps, or Velcro.

Alternatively, one may use the present invention without a liner 108. If a liner 108 is not used, then after using a portable container 100 of the present invention, the portable container 100 must either be discarded or cleaned for another use.

A gel pack 112 is placed in the liner 102 prior to use. In the preferred embodiment, the gel pack 112 of the present invention is a rectangular plastic pack in which gel powder 306 is vacuum sealed such that the gel pack 112 has sealed edges 302, 304. The plastic of the gel pack 112 is made of a commercially available water soluble material that dissolves on contact with liquids, e.g. liquid waste products. Gel packs 112 as described herein are well known in the prior art and are commercially available. Gel powders 306 are also well known in the relevant arts and commercially available. When such a gel powder 306 contacts a liquid waste product, the liquid waste product solidifies into a solid gel form, thereby eliminating most odors associated with the liquid waste product and making it easier to dispose of. The use of a water soluble gel pack 112 as described herein is for convenience purpose only. It would be readily apparent to one of ordinary skill in the relevant arts to use a comparable means for solidifying a liquid waste product, e.g., the use of a gel powder 306 in a liner 108 without a water soluble pack, the use of gel powder tablets, the use of a liner 108 having an interior surface treated with a gel powder 306, or any other comparable means.

In an alternative embodiment, a female adaptor (or comparable funnel-like apparatus) may be incorporated onto the top of the expandable container 102, thereby facilitating the use of the present invention by a woman. A female adaptor may also be placed in contact with the opening of the expandable container 102. Female adaptors are well known in the relevant arts and are commercially available in a variety of shapes and sizes. It would be readily apparent for one of ordinary skill in the relevant art to use a female adaptor with the portable container 100 of the present invention.

All references to shapes, dimensions, and materials are for convenience purpose only. It would be readily apparent to one of ordinary skill in the relevant art to make the present invention of a different shape, size, and material.

B. Operation

In the preferred embodiment, the portable container 500 of the present invention is packaged with all of the components needed for repeated use. Specifically, the expandable container 102 is stored in a retracted position 202 and the following components are contained within for easy storage, access and use: five (5) liners 108, five (5) gel packs 112, and five (5) rubber bands 110. In addition, five (5) toweletts 502 and a privacy cloth 504 may optionally be included and stored in the expandable container 102 to assist a person in using the portable container 100 and making it a more comfortable experience. By including five (5) units of each component, the portable container 100 is available for repeated use, wherein one (1) of each component is needed during a single use. The inclusion of five (5) of each component is used for convenience purposes. It would be readily apparent to one of ordinary skill in the relevant art to include a different number of each component thereby providing for repeated use of the portable container 100 of the present invention.

To use the portable container 100 of the present invention, a user performs the following steps: First, if a lid 204 is on the expandable container 102, the user removes the lid 204 and the contents contained therein, and extends the expandable container 102 to a desired size. In the preferred embodiment, the user would fully expand the expandable container 102 to its maximum extended position 104, but this is for convenience only. If available, the user may place a privacy cloth 504 over himself/herself to be shielded from view.

Next, the user places a gel pack 112 in a liner 108. The liner 108 with the gel pack 112 disposed therein, is slid into the expandable container 102. In the preferred embodiment, the liner 108 is secured, e.g., with a rubber band 110, to the opening 114 of the expandable container 102 to prevent the liner 108 from slipping out of position, but this is for convenience only. It alternative embodiments, a user may hold the edges of the liner 108 in place or use another means for securing the liner 108 to the expandable container 102 as described above.

Once the portable container 100 is prepared as described, the user introduces a liquid or liquid waste product into the liner 108 wherein the liquid waste product reacts with the gel pack 112. The water soluble packaging of the gel pack 112 dissolves thereby enabling the gel powder 306 to react with and absorb the liquid resulting in the liquid solidifying to a gel form within seconds after deposit, thereby creating a solidified waste product.

After the liquid waste product is transformed into a solidified waste product, the user removes the rubber band 110, if used, and pulls the liner 108 containing the solidified waste product from the expandable container 102. The user closes and secures the liner 108 using either the rubber band 110 that held the liner 108 to the expandable container 102 or by another means, e.g., a tie, twistie-tie 506, knot, clip or fastener. Once the liner 108 and the solidified waste product are secure, the user may dispose of it by appropriate means such as placing it in a trash receptacle. Finally, the user may replace any remaining, unused components back into the expandable container 102 for future use.

The operation and use of the disposable container 100 of the present invention is described in these terms for convenience purpose only. It would be readily apparent for a user to alter the method of using the disposable container 100 without changing its functionality. For example, a user may place the gel pack 112 in the liner 108 after the liner 108 is placed in the expandable container 102. Also, the gel pack 112 may be introduced to the liquid waste product after the liquid waste product is already deposited into the liner 108 within the expandable container 102.

CONCLUSION

While various embodiments of the present invention have been described, it should be understood that they have been presented by the way of example only, and not limitation. It will be understood by those skilled in the art that various changes in form and details may be made therein without departing from the spirit and scope of the invention. Thus, the breadth and scope of the present invention should not be limited by any of the above-described exemplary embodiments, but should be defined in accordance with the described terms and their equivalents.

What is claimed is:

1. A portable container for disposing of a liquid waste product, comprising:

an expandable container having an opening, wherein said expandable container can be vertically interchanged between a retracted position and an expanded position;

a liner for insertion into said expandable container, a means for securing said liner to the opening of said expandable container, wherein said means for securing is a rubber band or tie; and a means for solidifying the liquid waste product deposited within said liner.

2. The portable container according to claim 1, wherein said means for solidifying the liquid waste product is a water soluble gel pack.

3. The portable container according to claim 1, wherein said expandable container is made of a flexible plastic material having an expandable accordion wall structure.

4. The portable container according to claim 3, wherein a portion of said expandable container is rigid.

5. The portable container according to claim 1, further comprising a lid.

6. A method for using a portable container for disposing of a liquid waste product, the portable container having an expandable container with an opening wherein the expandable container can be vertically interchanged between a retracted position and an expanded position, a liner for insertion into the expandable container, and a means for solidifying the liquid waste product deposited in the liner, said method comprising the steps of:

(a) inserting the liner into the expandable container, (b) securing the liner to the opening of the expandable container with a rubber band or tie;

(c) depositing the means for solidifying the liquid waste product into the liner within the expandable container;

(d) depositing the liquid waste product into the liner within the expandable container such that the liquid waste product contacts the means for solidifying the liquid waste product, thereby generating a solidified waste product; and (e) removing the liner containing the solidified waste product from the expandable container for disposal.

7. The method according to claim 6, further comprising:

(e) securing the liner closed wherein the solidified waste product is contained within the liner.

8. The method according to claim 6, wherein the means for solidifying the liquid waste product is a water soluble gel pack.

9. The method according to claim 6, where said step (c) is performed prior to said step (a).

10. The method according to claim 6, wherein said step (a) is performed prior to said step (c).

11. A portable container for repeatedly disposing of a liquid waste product, comprising:

an expandable container having an opening and a lid, wherein said expandable container can be vertically interchanged between a retracted position and an expanded position;

a plurality of liners, wherein each of said liners can be inserted into said expandable container, a plurality of water soluble gel packs, wherein each of said water soluble gel packs solidifies the liquid waste product deposited within said liner, and a plurality of rubber bands or ties, wherein each of said rubber bands or ties secures one said liner to the opening of said expandable container;

wherein said plurality of liners, said plurality of water soluble gel packs, and said plurality of rubber bands or ties are stored within said expandable container prior to use of the portable container, and wherein during use, one said liner, one said water soluble gel pack and one said rubber band or tie are used with said expandable container.

12. The portable container according to claim 11, further comprising a plurality of towelettes that are stored within said expandable container prior to use.

13. The portable container according to claim 11, further comprising a privacy cloth that is stored within said expandable container prior to use.

* * * * *